US006762389B1

(12) United States Patent
Crooks et al.

(10) Patent No.: US 6,762,389 B1
(45) Date of Patent: Jul. 13, 2004

(54) GAS DISCHARGE FILTER FOR ELECTRICAL SWITCHING APPARATUS

(75) Inventors: William M. Crooks, Sumter, SC (US); Francis C. Campbell, Camden, SC (US); David K. Haag, Sumter, SC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/417,662

(22) Filed: Apr. 17, 2003

(51) Int. Cl.[7] ..... H01H 33/08
(52) U.S. Cl. ..... 218/157; 218/35
(58) Field of Search ..... 218/157, 35, 147, 218/154–156, 34–39; 335/201, 202

(56) References Cited

U.S. PATENT DOCUMENTS

| | | | | |
|---|---|---|---|---|
| 3,621,169 A | * | 11/1971 | Heft et al. | 218/152 |
| 4,876,424 A | | 10/1989 | Leone et al. | |
| 5,194,840 A | | 3/1993 | Frutuoso et al. | |
| 5,241,289 A | | 8/1993 | Markowski et al. | |
| 5,317,117 A | | 5/1994 | Bruski et al. | |
| 5,493,092 A | | 2/1996 | Rowe | |
| 5,753,877 A | | 5/1998 | Hartzel et al. | |
| 6,211,759 B1 | | 4/2001 | Little et al. | |
| 6,388,867 B1 | * | 5/2002 | Rakus et al. | 361/605 |
| 6,407,354 B1 | | 6/2002 | Turner et al. | |
| 6,512,192 B1 | | 1/2003 | Yee et al. | |
| 2002/0027489 A1 | | 3/2002 | Letient | |
| 2002/0144978 A1 | | 10/2002 | Leone et al. | |
| 2003/0025586 A1 | | 2/2003 | Parry et al. | |

* cited by examiner

*Primary Examiner*—Lincoln Donovan
*Assistant Examiner*—M. Fishman
(74) *Attorney, Agent, or Firm*—Martin J. Moran

(57) ABSTRACT

A gas discharge filter is for cooling ionized gases discharged from a circuit breaker. The circuit breaker includes separable contacts electrically connected in series between line and load terminals, a housing, an arc chamber within the housing structured to extinguish an arc between the separable contacts when opened, and an exhaust vent in the housing for discharging ionized gases developed from the arc. The gas discharge filter includes a heat exchanger for reducing the temperature of the discharged ionized gases, and a supporting member to secure the heat exchanger outside the housing and proximate the exhaust vent opening in the exhaust path for the discharged ionized gases. The discharge filter cools the discharged ionized gases as they pass through and around the heat exchanger thus reducing the likelihood of electrical faults associated therewith.

25 Claims, 6 Drawing Sheets

90

GAS DISCHARGE FILTER FOR ELECTRICAL SWITCHING APPARATUS

BACKGROUND OF THE INVENTION

1. Field of the Invention

The present invention relates generally to electrical switching apparatus and, more particularly, to circuit breakers, such as a molded case circuit breaker including an arc chamber and a gas discharge filter for avoiding inadvertent flow of electrical current due to ionized exhaust gases being discharged from the arc chamber. The invention also relates to gas discharge filters for electrical switching apparatus.

2. Background Information

Electrical switching apparatus include, for example, circuit switching devices and circuit interrupters such as circuit breakers, contactors, motor starters, motor controllers and other load controllers.

Circuit breakers are used to protect electrical circuitry from damage due to an over current condition, such as an overload condition or a relatively high level short circuit or fault condition. Circuit breakers typically have a molded plastic housing enclosing at least one pair of separable contacts which are operated either manually by way of a handle disposed on the outside of the housing or automatically by way of an internal trip unit in response to an over current condition.

When the circuit breaker separable contacts are opened under overload, short circuit or fault conditions, an arc is usually created which is accompanied by the generation of ionized gases. The ionized gases are conductive. If these ionized gases collect in the vicinity of the line terminals of the circuit breaker, they may cause a phase-to-phase electrical failure between the circuit breaker terminals, and/or a phase-to-ground electrical failure with any metallic enclosure within which the circuit breaker is mounted. This can lead to electrical faults on the line side of the circuit breaker and damage to switchgear equipment.

Circuit breakers typically include vents to allow the ionized gases to quickly escape therefrom. The problem of electrical faults is especially acute where the poles of the circuit breaker are in close proximity to the circuit breaker vents, thus subjecting each pole of the circuit breaker to hot ionized and electrically conductive exhaust gases. Accordingly, there is a need for preventing these kinds of electrical breakdowns.

Known prior art devices for preventing electrical faults caused by conductive ionized gases include gas deflectors, shields, and dampers.

U.S. Pat. No. 4,639,564 discloses a tubular wall in the cover of a circuit breaker which surrounds a terminal screw. The tubular wall includes a biased end face with the lower end of the face being disposed between the screw and the opening in a wall of a cover. This biased end face provides a cooling effect caused by siphoning or inward flow of air from the top of the tubular wall downwardly through the tubular wall and around the terminal screw from where it exhausts into the atmosphere through an outlet. Although the disclosure teaches the cooling of the gases by siphoning fresh air and mixing it with hot gases, the exhaust gases still remain relatively hot.

U.S. Pat. No. 4,650,940 discloses a circuit breaker having a flap or barrier, which is disposed within a terminal compartment and over the inner side of an opening for a screwdriver. The ionized gases flowing into the terminal compartment are stopped from flowing through the opening by the flap extending there across. The flap is preferably composed of a sheet of fiber or fiber type material, which is chemically and electrically impervious to hot ionized gases. However, because the shield is not fixed, it may move within the circuit breaker housing or be accidentally removed, thereby allowing a path for ionized gases to reach ground through the screwdriver opening.

U.S. patent application Ser. No. 09/919,474, filed Jul. 31, 2001, discloses an exhaust control device for reducing the temperature, velocity, and ionization level of gases produced in a circuit interrupter, specifically a fuse, upon interruption of a circuit. Ionized gases flow from the fuse into a casing having first and second expansion chambers configured to separate gases into first and second pressure waves that sequentially travel through a mesh heat sink and then a damper to reduce gas temperature, velocity, and ionization level. However, the disclosed exhaust device is complex and cumbersome, and therefore, not conducive for use in applications such as, for example, circuit breakers mounted within a switchgear cabinet (e.g., without limitation, a panel board or a load center), particularly multi-pole circuit breakers having an ionized gas exhaust vent at each pole.

Accordingly, there is room for improvement in gas discharge filters for electrical switching apparatus and in circuit breakers employing ionized gas discharge filters.

SUMMARY OF THE INVENTION

These needs and others are satisfied by the present invention, which is directed to a gas discharge filter for an electrical switching apparatus. The filter cools ionized gases discharged from an arc chamber in order to minimize electrical faults associated therewith.

As one aspect of the invention, a gas discharge filter is used with an electrical switching apparatus including a line side with line terminal means, a load side with load terminal means, separable contacts electrically connected in series between the line terminal means and the load terminal means, a housing, an arc chamber within the housing and structured to extinguish an arc between the separable contacts when opened, the housing having an exhaust vent opening for discharging through an exhaust path ionized gases which are developed from the arc, the ionized gases having a temperature. The gas discharge filter comprises: heat reduction means for reducing the temperature of the discharged ionized gases, and a supporting member for securing the heat reduction means outside the housing and proximate the exhaust vent opening in the exhaust path for the discharged ionized gases.

The heat reduction means may include a heat exchanger including a conductive insert member structured for removable insertion within the supporting member.

As another aspect of the invention, an electrical switching apparatus comprises: at least one line terminal; at least one load terminal; at least one pair of separable contacts electrically connected in series between the at least one line terminal and the at least one load terminal; a housing; at least one arc chamber within the housing and structured to extinguish an arc between the separable contacts when opened; the housing having at least one exhaust vent opening for discharging through at least one exhaust path ionized gases which are developed from the arc; the ionized gases having a temperature; and a gas discharge filter comprising: heat reduction means for reducing the temperature of the discharged ionized gases, and a supporting member for securing the heat reduction means outside the housing and proximate the at least one exhaust vent opening, in the exhaust path for the discharged ionized gases.

As another aspect of the invention, a power distribution system comprises: a switchgear cabinet, an electrical switching apparatus coupled to the switchgear cabinet, the electrical switching apparatus including at least one line terminal, at least one load terminal, at least one pair of separable contacts electrically connected in series between the at least one line terminal and the at least one load termninal, a housing, at least one arc chamber within the housing and structured, to extinguish an arc between the separable contacts when opened, the housing having at least one exhaust vent opening for discharging through at least one exhaust path ionized gases which are developed from the arc, the ionized gases having a temperature, and a gas discharge filter comprising: heat reduction means for reducing the temperature of the discharged ionized gases, and a supporting member for securing the heat reduction means outside the housing and proximate the at least one exhaust vent opening, in the exhaust path for the discharged ionized gases.

The switchgear cabinet may include a securing element structured to secure the supporting member to the switchgear cabinet.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

For purposes of illustration, the present invention will be described as applied to a multi-pole circuit breaker, although it will become apparent that it could also be applied to other types of electrical switching apparatus (e.g., without limitation, circuit switching devices, and other circuit interrupters such as contactors, motor starters, motor controllers, and other load controllers) having one or more poles.

As employed herein, the term "ionized" means completely or partially converted into ions and being electrically conductive such as, for example, ionized gases generated by arcing between separable electrical contacts of a circuit breaker when opened.

As employed herein, the term "heat exchanger" refers to a temperature reducing mechanism having a relatively large surface area consisting of, for example, flat plates, perforations, coiled material and/or combinations thereof, made from a: thermally conductive material and structured to provide relatively rapid heat reduction of a fluid, such as, for example, hot ionized gases discharged from a circuit breaker.

As employed herein, the term "switchgear cabinet" refers to the cabinet of a power distribution system such as, for example, a panel board or a load center, which is structured to secure electrical switching apparatus, expressly including, but not limited to, circuit breakers.

Figure 1:
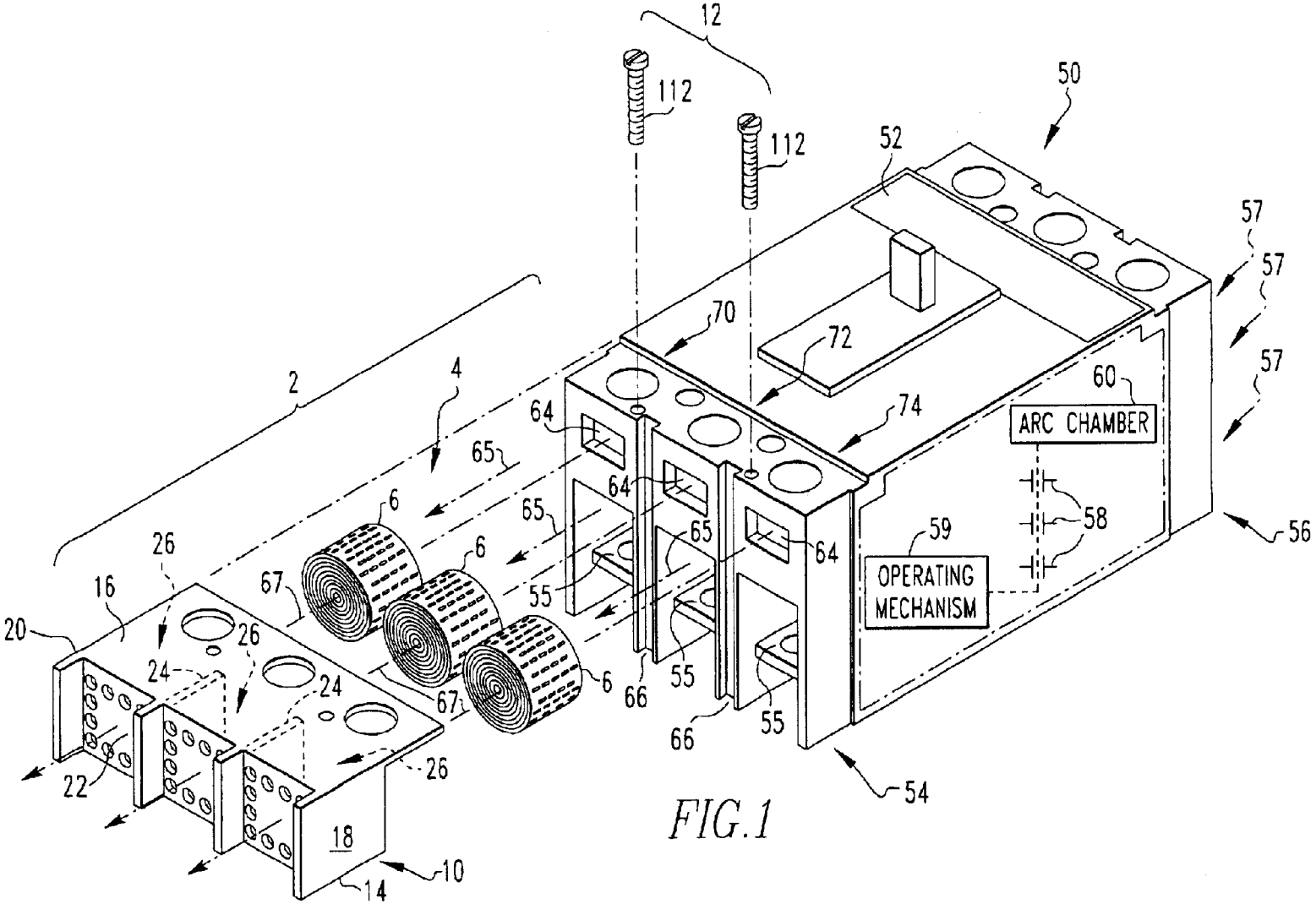
FIG. 1 is an exploded, isometric view of a circuit breaker with a gas discharge filter, with the circuit breaker housing partially cut-away to show internal structures.

FIG. 1 illustrates a discharge filter 2 for use with a circuit breaker 50. As shown, the basic components of the circuit breaker 50 include a line side 54 having a plurality of line terminals 55, a load side 56 having a plurality of load terminals 57, separable contacts 58 electrically connected in series between the line side terminals 55 and the load side terminals 57, an operating mechanism 59, which opens and closes the separable contacts 58, a housing 52, and an arc chamber 60 within the housing 52 structured to extinguish an arc between the separable contacts 58 when opened. The housing 52 further includes a plurality of exhaust vent openings 64. The exhaust vent openings 64 are structured to discharge ionized gases 65 from within the arc chamber 60. As is well known, the ionized gases 65 develop from arcs (not shown) between the separable contacts 58 when opened under certain overload, fault or short circuit conditions. If these ionized gases 65 collect in the vicinity of the line terminals 55 of the circuit breaker 50, they may cause a phase-to-phase electrical failure between the circuit breaker poles 70,72,74, for example, and/or a phase-to-ground electrical failure with any metallic enclosure within which the circuit breaker 50 is mounted (see switchgear cabinet 100 of FIG. 9, for example). To eliminate such electrical faults, the gas discharge filter 2 in accordance with the present invention, may be employed as shown in FIG. 1.

Figure 7:
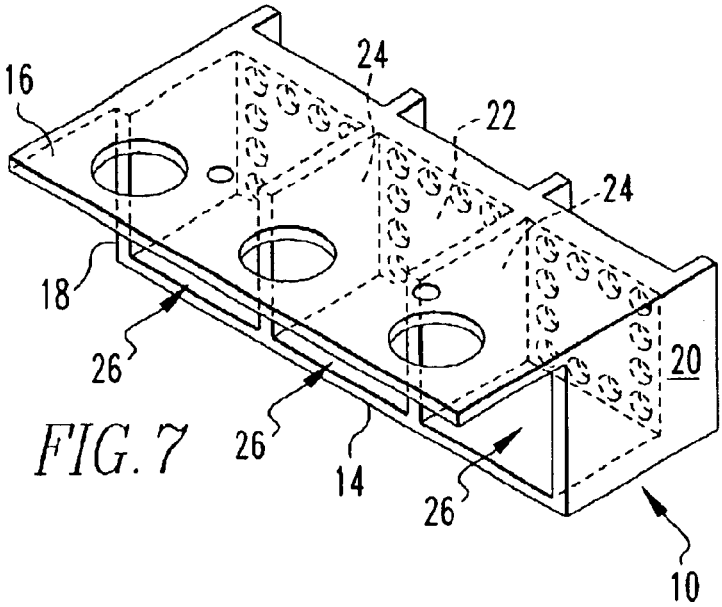
FIG. 7 is an isometric view of the supporting member of FIG. 1.

Continuing to refer to FIG. 1, the gas discharge filter 2 includes a suitable heat reduction mechanism for reducing the temperature and associated electrical conductivity of the discharged ionized gases 65. As shown, the heat reduction mechanism may comprise heat exchangers 4 such as, for example, conductive insert members 6. A supporting member 10 secures the insert members 6 outside the housing 52 proximate the exhaust vent openings 64 such that the heat exchangers 4 are disposed within the exhaust path 67 of the ionized gases 65. The exemplary supporting member 10 includes a bottom 14, a top 16, first and second side walls 18,20, a perforated front wall 22 integral with and extending between the bottom 14 and the top 16, and one or more barriers 24 (two are shown in FIG. 1) depending from the perforated front wall 22 for forming a plurality of insulating compartments 26 structured to provide insulated separation of the heat exchangers 4 within the supporting member 10 (as best shown in FIG. 7). In the example of FIG. 1, the supporting member 10 is attached to the housing 52 of the circuit breaker 50 using an attachment device 12 such as, for example, a plurality of threaded fasteners 112. The ionized gases 65 are discharged through the exhaust vent openings 64 in the housing 52 of the circuit breaker 50. The discharged ionized gases 65 flow into the separate insulting compartments 26 through and around the heat exchangers 4, such as the conductive insert members 6 housed therein, or the coiled inserts 106 removably inserted within the insulating compartments 26 of FIG. 10. The conductive insert members 6 of FIG. 1 cool the discharged ionized gases 65 greatly decreasing their electrical conductivity as they continue flowing through the insulating compartments 26 and out through the perforated front walls 22,122 of the supporting members 10,110 of FIGS. 7 and 8, respectively, into the outside ambient air. Additionally, the barriers 24,124 of the insulating compartments 26,126 of the supporting members 10,110 electrically separate the circuit breaker poles 70,72,74, for example, further reducing the likelihood of a phase-to-phase electrical fault.

FIGS. 2–5 show alternative embodiments of the conductive insert members 6 of FIG. 1. Each of these conductive insert members is structured for. removable insertion within the insulating compartments 26 of a supporting member, such as member 10 of FIG. 10 or member 110 of FIG. 8.

Figure 2:
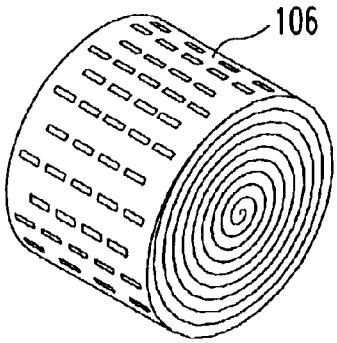
FIG. 2 is an isometric view of a conductive insert member for a gas discharge filter in accordance with the present invention.

FIG. 2 shows a conductive insert member, which is a coiled screen insert 106. The exemplary coiled screen insert 106 is made from copper mesh rolled into a structure having a substantially annular cross-section. The rolled structure and the perforations therein increase the surface area of the coiled screen insert 106, thus providing a thermally conductive heat exchanger that greatly reduces the temperature of the discharged ionized gases (e.g., 65 of FIG. 1) as they pass through and around the coiled screen insert 106. By reducing the temperature of the discharged ionized gases 65, the electrical conductivity of such ionized gases is reduced thereby minimizing the likelihood of an electrical failure associated therewith.

Figure 3:
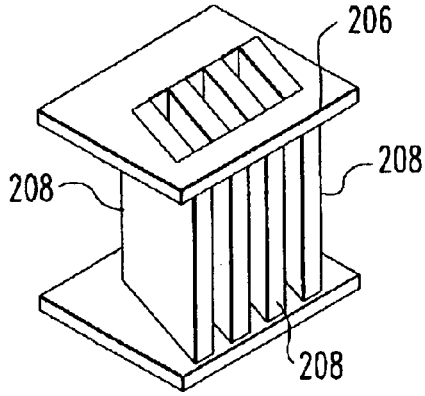
FIG. 3 is an isometric view of a conductive insert member for a gas discharge filter in accordance with another embodiment of the invention.

As shown in FIG. 3, another conductive insert member embodiment includes a conductive insert member 206 having a plurality of flat plates 208 disposed in a substantially parallel array. Similar to the coils and perforations of the coiled screen insert 106 of FIG. 2, the plurality of flat plates 208 disposed in a substantially parallel array provide increased surface area and are made from thermally conductive material such as, for example, metal, and therefore, rapidly reduce the temperature of the discharged ionized gases passing through and around the substantially parallel array of flat plates 208.

Figure 4:
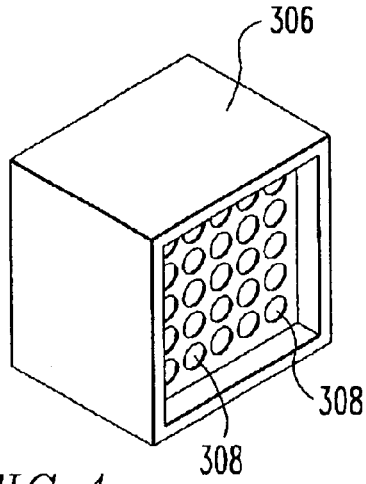
FIG. 4 is an isometric view of a conductive insert member for a gas discharge filter in accordance with another embodiment of the invention.

FIG. 4 shows a conductive insert member that is a machined perforated insert 306. The insert may be machined from a material such as, for example, metal, to include a plurality of perforations 308, in order to increase the thermally conductive surface area therein. However, it will be appreciated that such inserts may be made from processes other than machining, such as, for example, forming or casting. Additionally, the machined perforated insert 306 may be a variety of shapes and sizes (not shown), and may be made from a wide variety of materials (not shown).

Figure 5:
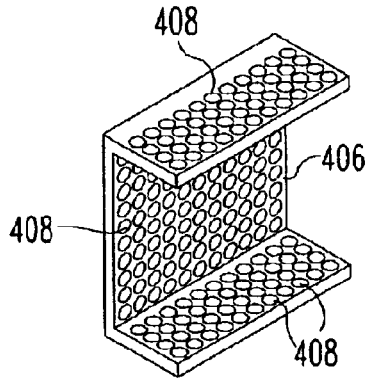
FIG. 5 is an isometric view of a conductive insert member for a gas discharge filter in accordance with another embodiment of the invention.

FIG. 5 shows a conductive insert member that is a perforated flat screen insert 406. As shown, the perforated flat screen insert 406 may be structured to facilitate removable insertion within, for example, the insulating compartments 26 of the supporting member 10 (see, for example, coiled screen inserts 106 removably inserted within insulating compartments 26 of FIG. 10). The plurality of perforations 408 in the flat screen insert 406 provide increased surface area to reduce the temperature of discharged ionized gases (e.g., 65 of FIG. 1).

Figure 6:
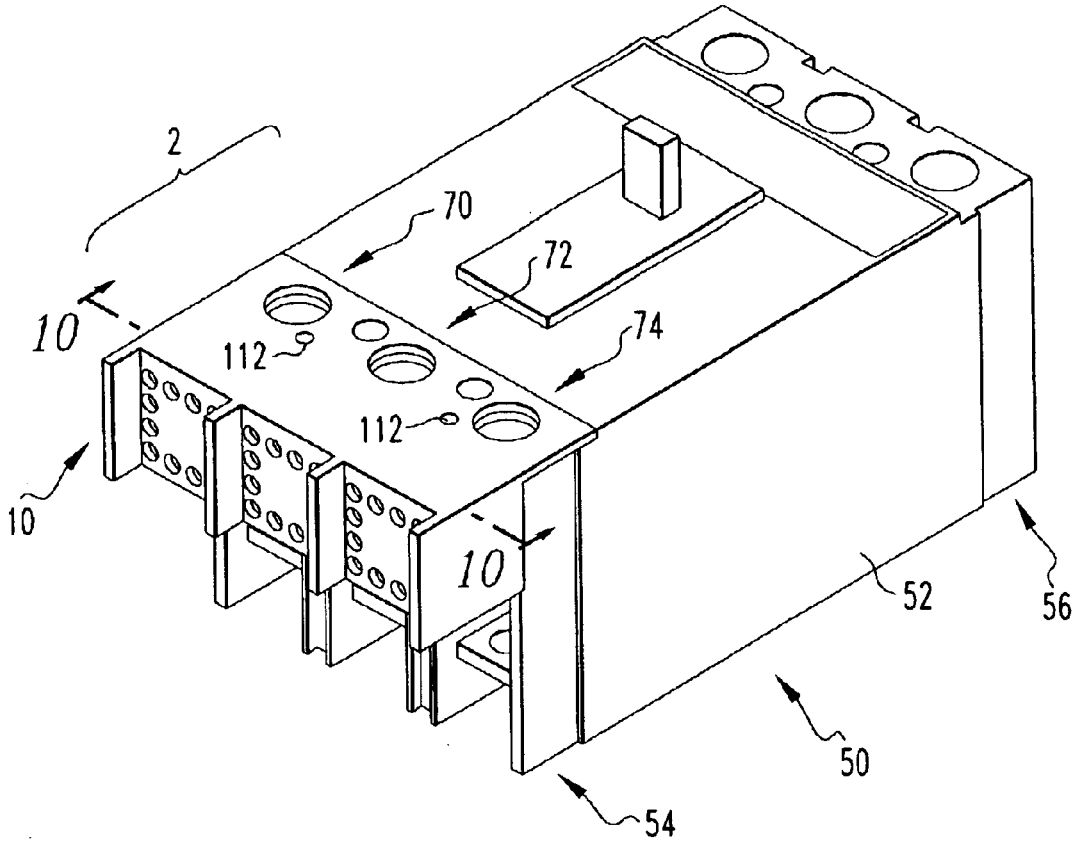
FIG. 6 is an isometric view of the assembly of FIG. 1.

FIG. 6 shows the gas discharge filter 2 as employed on the circuit breaker 50. In use, the gas discharge filter 2 may be attached to the outside of the circuit breaker housing 52, as shown, using the attachment device 12 (shown in FIG. 1) in the form of threaded fasteners 112, in order that the heat exchangers 4 (FIG. 1) removably inserted within the insulating compartments 26 (FIG. 7) of the supporting member 10 are supported proximate the exhaust vent openings 64 (FIG. 1) for the circuit breaker poles 70,72,74 (FIG. 1).

Figure 10:
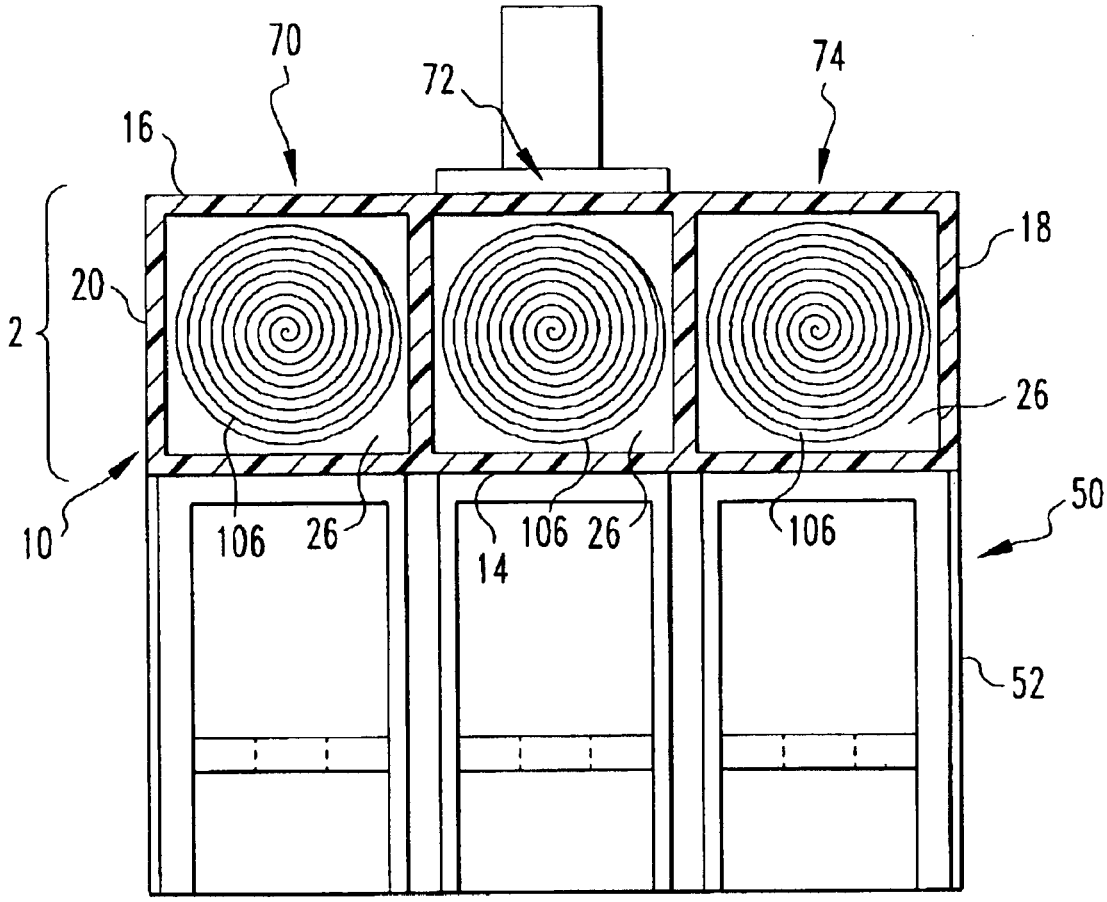
FIG. 10 is a sectional view taken along lines 10—10 of FIG. 6.

FIG. 7 shows the supporting member 10. The supporting member 10 includes two barriers 24 forming three insulating compartments 26 to house three heat exchangers (e.g., 4 of FIG. 1), one corresponding to each of the circuit breaker poles 70,72,74 of the exemplary circuit breaker 50 (FIGS. 1 and 10). However, it will be appreciated that any number of barriers 24 forming any number of insulating compartments 26 could be employed to house such heat exchangers.

Figure 8:
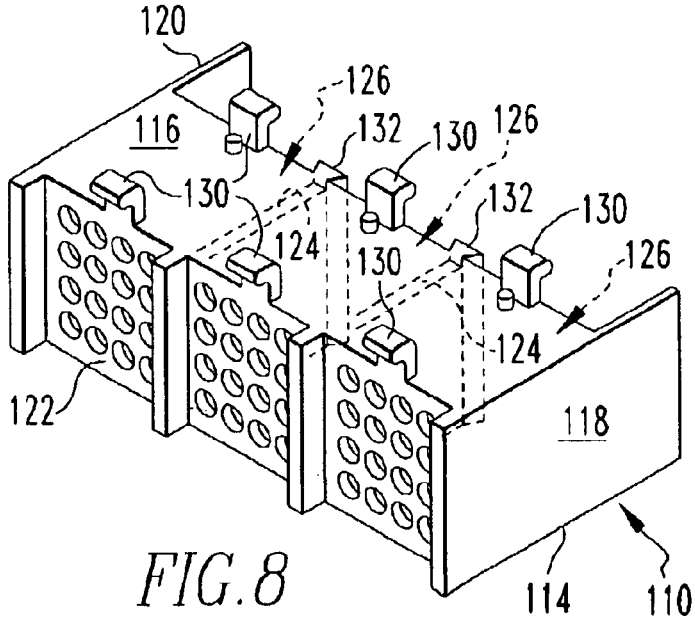
FIG. 8 is an isometric view of a supporting member in accordance with another embodiment of the invention.
Figure 9:
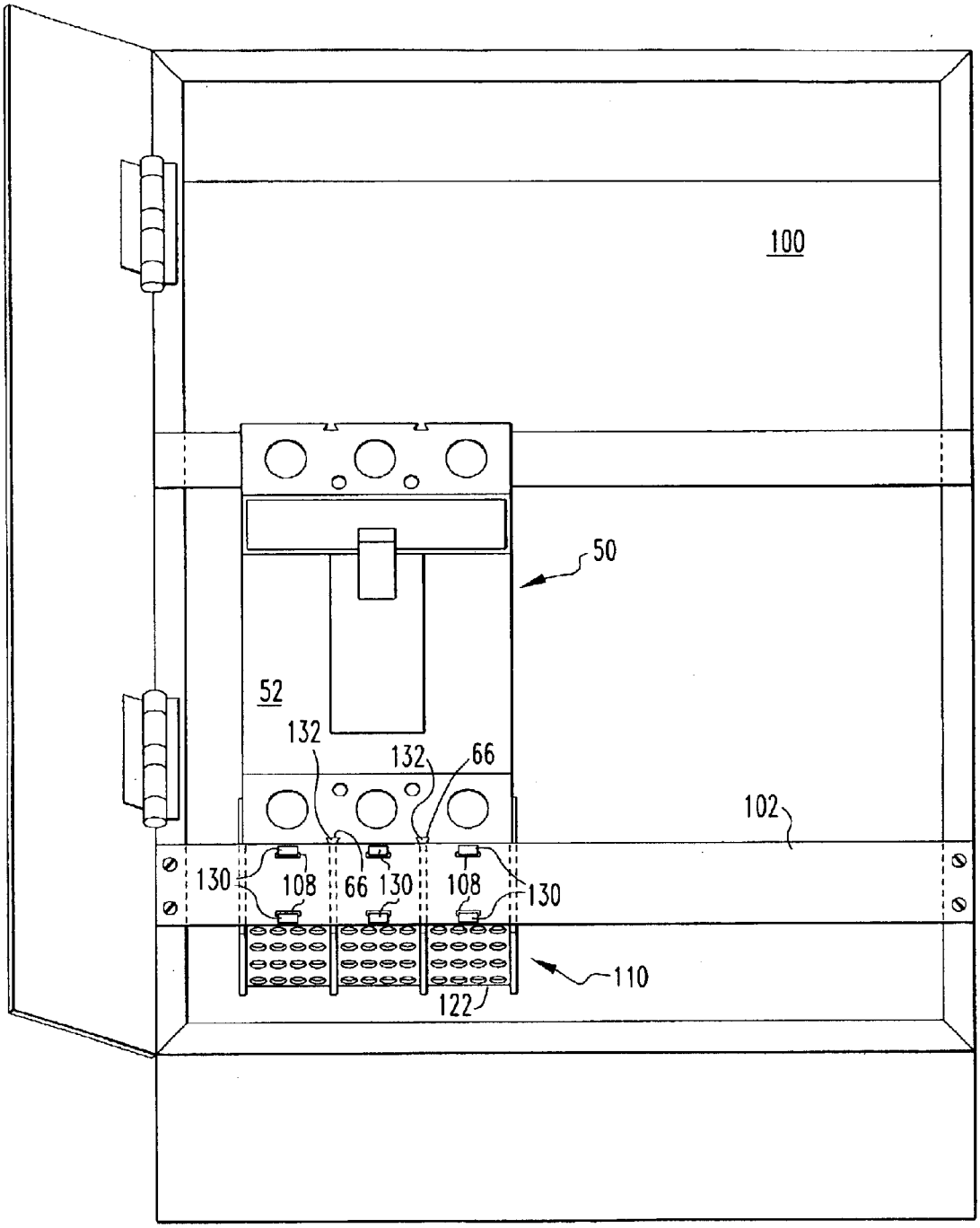
FIG. 9 is a plan view of the supporting member of FIG. 8 as employed with a circuit breaker disposed within a switchgear cabinet in accordance with another embodiment of the invention.

FIG. 8 shows an alternative supporting member 110 embodiment. Like the supporting member 10 of FIG. 7, the supporting member 110 includes a bottom 114, a top 116, first and second side walls 118,120, a perforated front wall 122 integral with and extending between the bottom 114 and top 116, and one or more barriers 124 depending from the perforated front wall 122 for forming a plurality of insulating compartments 126 within the supporting member 110. As shown, the supporting member 110 may further include molded tabs 130 and dovetail protrusions 132. The dovetail protrusions 132 are structured for insertion within elongated slots 66 (FIGS. 1 and 9) within the housing 52 of the circuit breaker 50 (as best shown in FIG. 9). The molded tabs 130 of the supporting member 110 are structured for insertion within receiving slots 108 on a securing element 102 to secure the supporting member 10 thereto within the switchgear cabinet 100 of a power distribution system 90 (FIG. 9).

The discharge filter 2 may be attached directly to the housing 52 of the circuit breaker 50 as shown in FIG. 6, to an external structure such as the switchgear cabinet 100 or securing element 102 secured thereto (FIG. 9), or to both the circuit breaker housing 52 and an external structure (see, for example, the supporting member 110 attached to both the circuit breaker housing 52 by the dovetail protrusions 132 and to the securing element 102 by molded tabs 130 of FIG. 9).

As shown in FIG. 9, the supporting member 110 may be secured independently from the circuit breaker 50 by the securing element 102. Here, in this embodiment, the dovetail protrusions 132 need not be employed.

It will be appreciated, therefore, that a variety of electrical switching apparatus, in addition to the circuit breaker 50 shown within the switchgear cabinet 100 of FIG. 9, may be interchanged to employ the same gas discharge filter 2. While the exemplary supporting member 110 is shown attached to a securing element 102 which is in turn attached to the switchgear cabinet 100, it will also be appreciated that the supporting member 110 could alternatively be secured directly to the switchgear cabinet 100 (not shown). Additionally, the switchgear cabinet 100 is shown with only one circuit breaker 50 disposed therein for illustrative purposes only. The power distribution system 90 could also employ additional circuit breakers 50 or other electrical switching apparatus (not shown).

FIG. 10 shows a cross-section of the discharge filter 2 as employed on the circuit breaker 50 to show further detail of the supporting member 10 and the heat reduction mechanism therein. As shown, the supporting member bottom 14, top 16, first and second side walls 18,20, and barriers 24 form a plurality of the insulating compartments 26 to separate the poles 70,72,74 of the circuit breaker 50 and to house heat exchangers, such as the coiled screen inserts 106, therein.

The conductive insert members structured for removable insertion within the insulating compartments 26 of the supporting member 10 are shown as coiled screen inserts 6,106 for illustrative purposes only. Alternative conductive insert members expressly include, but are not limited to, conductive insert members 206 having a plurality of flat plates 208 disposed in a substantially parallel array (FIG. 3), perforated machined inserts 306 (FIG. 4), and flat screen inserts 406 (FIG. 5). Furthermore, while the exemplary gas discharge filter 2 is shown as being employed on the line side 54 of the circuit breaker 50, it will be appreciated that such a discharge filter could be employed on the load side of a circuit breaker as well.

Accordingly, the gas discharge filter 2 of the present invention provides an effective, simplistic and economic way to effectively reduce electrical faults associated with hot, conductive ionized gases discharged from a molded case circuit breaker.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A gas discharge filter for use with an electrical switching apparatus, said electrical switching apparatus including a line side with line terminal means, a load side with load terminal means, separable contacts electrically connected in series between said line terminal means and said load terminal means, a housing, an arc chamber within said housing and structured to extinguish an arc between said separable contacts when opened, said housing having at least one exhaust vent opening for discharging through an exhaust path ionized gases which are developed from said arc, said ionized gases having a temperature, said gas discharge filter comprising:

a single conductive insert member for each of said at least one exhaust vent opening, each said since conductive insert member structured to reduce the temperature of said discharged ionized gases; and a supporting member for securing said conductive insert member outside said housing and proximate one of said at least one exhaust vent opening in the exhaust path for said discharged ionized gases.

2. The gas discharge filter of claim 1 wherein said single conductive insert member is structured to exchange heat.

3. The gas discharge filter of claim 1 wherein said single conductive insert member is structured for removable insertion within said supporting member.

4. The gas discharge filter of claim 3 wherein said single conductive insert member is a coiled screen insert.

5. The gas discharge filter of claim 1 wherein said supporting member includes an attachment device structured to secure said supporting member outside said housing, in order that said single conductive insert member is secured adjacent to one of said at least one exhaust vent opening.

6. The gas discharge filter of claim 5 wherein said attachment device includes a plurality of threaded fasteners.

7. The gas discharge filter of claim 1 wherein said electrical switching apparatus is a circuit breaker including a plurality of poles; wherein said housing includes a plurality of exhaust vent openings for the poles of said circuit breaker; wherein said single conductive insert member includes one conductive insert member for each of the poles of said circuit breaker; and wherein said supporting member supports each said one conductive insert member outside said housing and proximate one of said exhaust vent openings for the poles of said circuit breaker.

8. An electrical switching apparatus comprising:

at least one line terminal;

at least one load terminal;

at least one pair of separable contacts electrically connected in series between said at least one line terminal and said at least one load terminal;

a housing;

at least one arc chamber within said housing and structured to extinguish an arc between said separable contacts when opened;

said housing having at least one exhaust vent opening for discharging through at least one exhaust path ionized gases which are developed from said arc, said discharged ionized gases having a temperature; and a gas discharge filter comprising: beat reduction means a single conductive insert member for a single conductive insert member structured to reduce the temperature of said discharged ionized gases; and a supporting member for securing each said single conductive insert member outside said housing and proximate said at least one exhaust vent opening, in the at least one exhaust path for said discharged ionized gases.

9. The electrical switching apparatus of claim 8 wherein each said single conductive insert member is structured to exchange beat.

10. The electrical switching apparatus of claim 8 wherein each said single conductive insert member is structured for removable insertion within said supporting member.

11. The electrical switching apparatus of claim 8 wherein said supporting member includes an attachment device structured to secure said supporting member outside said housing, in order that each said single conductive insert member is secured adjacent to one of said at least one exhaust vent opening.

12. The electrical switching apparatus of claim 8 wherein said electrical switching apparatus is a circuit breaker including a plurality of poles; wherein said at least one exhaust vent opening in said housing is a plurality of exhaust vent openings in said housing; wherein said single conductive insert member includes one conductive insert member for each of the poles of said circuit breaker; and wherein said supporting member supports each said one conductive insert member outside said housing and proximate one of said exhaust vent openings for the poles of said circuit breaker.

13. The gas discharge filter of claim 12 wherein said supporting member includes a bottom, a top, first and second sidewalls, a perforated front wall integral with and extending between said bottom and said top, and at least one barrier depending from said perforated front wall for forming a plurality of insulating compartments within said supporting member, said plurality of insulating compartments being structured to provide insulated separation of each said one conductive insert member without requiring a separate insulator therebetween.

14. The gas discharge filter of claim 13 wherein each said one conductive insert member is structured for removable insertion within the insulating compartments of said supporting member.

15. A power distribution system comprising:

a switchgear cabinet;

an electrical switching apparatus coupled to said switchgear cabinet, said electrical switching apparatus including at least one line terminal, at least one load terminal, at least one pair of separable contacts electrically connected in series between said at least one line terminal and said at least one load terminal, a housing, at least one arc chamber within said housing and structured to extinguish an arc between said separable contacts when opened, said housing having at least one exhaust vent opening for discharging through at least one exhaust path ionized gases which are developed from said arc, said discharged ionized gases having a temperature; and a gas discharge filter comprising:

a single conductive insert member for each of said at least one exhaust vent opening, each said single conductive insert member structured to reduce the temperature of said discharged ionized gases; and a supporting member for securing each said single conductive insert member outside said housing and proximate one of said at least one exhaust vent opening, in the exhaust path for said discharged ionized gases.

16. The power distribution system of claim 15 wherein each said single conductive insert member is structured to exchange heat.

17. The power distribution system of claim 16 wherein each said single conductive insert member is structured for removable insertion within said supporting member.

18. The power distribution system of claim 15 wherein said supporting member includes an attachment device structured to secure said supporting member outside said housing, in order that each said single conductive insert member is secured adjacent to one of said at least one exhaust vent opening of said housing.

19. The power distribution system of claim 15 wherein said supporting member is secured to said switchgear cabinet.

20. The power distribution system of claim 19 wherein said switchgear cabinet includes a securing element structured to secure said supporting member to said switchgear cabinet.

21. The power distribution system of claim 20 wherein said securing element includes a plurality of receiving slots; and wherein said supporting member includes a plurality of molded tabs structured to engage said receiving slots of said securing element to secure said supporting member thereto.

22. The power distribution system of claim 15 wherein said electrical switching apparatus is a circuit breaker including a plurality of poles; wherein said at least one exhaust vent opening in said housing is a plurality of exhaust vent openings in said housing; wherein said single conductive insert member includes one conductive insert member for each of the poles of said circuit breaker; and wherein said supporting member supports each said one conductive insert member outside said housing and proximate one of said exhaust vent openings for the poles of said circuit breaker.

23. The power distribution system of claim 22 wherein said supporting member includes a bottom, a top, first and second sidewalls, a perforated front wall integral with and extending between said bottom and said top, and at least one barrier depending from said perforated front wall for forming a plurality of insulating compartments within said supporting member, said plurality of insulating compartments being structured to provide insulated separation of each said one conductive insert member without requiring a separate insulator therebetween.

24. The power distribution system of claim 23 wherein each said one conductive insert member is structured for removable insertion within a corresponding one of the insulating compartments of said supporting member.

25. The gas discharge filter of claim 4 wherein said coiled screen insert is a single piece of perforated metal rolled into a coil.

* * * * *